US009714134B2

(12) United States Patent
Tacchi et al.

(10) Patent No.: US 9,714,134 B2
(45) Date of Patent: Jul. 25, 2017

(54) PACKET WITH A RECLOSABLE SEALING PANEL

(71) Applicant: G.D SOCIETA' PER AZIONI, Bologna (IT)

(72) Inventors: Alver Tacchi, Bologna (IT); Lorena D'Alfonso, Lettomappello (IT); Roberto Polloni, Modigliana (IT); Stefano Negrini, Calderara di Reno (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 14/891,698

(22) PCT Filed: May 21, 2014

(86) PCT No.: PCT/IB2014/061597

§ 371 (c)(1),
(2) Date: Nov. 17, 2015

(87) PCT Pub. No.: WO2014/188357

PCT Pub. Date: Nov. 27, 2014

(65) Prior Publication Data

US 2016/0096678 A1 Apr. 7, 2016

(30) Foreign Application Priority Data

May 21, 2013 (IT) ..... BO2013A0235

(51) Int. Cl.
*B65D 85/10* (2006.01)
*B65D 5/54* (2006.01)

(52) U.S. Cl.
CPC ..... *B65D 85/1045* (2013.01); *B65D 5/548* (2013.01); *B65D 85/1036* (2013.01)

(58) Field of Classification Search
CPC . B65D 85/1045; B65D 85/1036; B65D 5/548
USPC ..... 206/268, 271, 273, 264, 265
See application file for complete search history.

(56) References Cited

U.S. PATENT DOCUMENTS 4,300,676 A * 11/1981 Focke ..... B65D 85/1045 206/264
6,164,444 A * 12/2000 Bray ..... B65D 75/5838 206/264

(Continued)

FOREIGN PATENT DOCUMENTS

DE 102009034705 A1 1/2011
DE 102010027175 A1 1/2012
EP 1961675 A1 8/2008

OTHER PUBLICATIONS

International Search Report and Written Opinion, International Application No. PCT/IB2014/061597, mailed Sep. 3, 2014.

(Continued)

*Primary Examiner* — Chun Cheung
(74) *Attorney, Agent, or Firm* — Marshall, Gerstein & Borun LLP

(57) ABSTRACT

A packet having: a group of articles; a sealed package enclosing the group of articles and having a first cover flap, which is defined by a first cut through the sealed package and is movable to allow access to the group of articles; a rigid container enclosing the sealed package and having a second cover flap, which is defined by a second cut through the container, is superimposed on the first cover flap of the sealed package, and is movable to allow access to the sealed package; and a reclosable adhesive panel, which is coated on the inside with re-stick adhesive, and has a grip tab with no re-stick adhesive and located at an edge of the adhesive panel.

18 Claims, 16 Drawing Sheets

(56) References Cited

U.S. PATENT DOCUMENTS

| | | | | |
|---|---|---|---|---|
| 6,478,149 | B1 * | 11/2002 | Parker | B65D 5/18 206/264 |
| 6,505,735 | B1 * | 1/2003 | Parker | B65D 75/5838 206/265 |
| 7,827,769 | B2 * | 11/2010 | Bertuzzi | B65B 19/20 206/271 |
| 8,123,030 | B2 * | 2/2012 | Hein | B65B 19/20 206/273 |
| 8,590,701 | B2 * | 11/2013 | Bertuzzi | B65D 5/543 206/264 |
| 2009/0308766 | A1 * | 12/2009 | Polloni | B65D 85/1036 206/264 |
| 2009/0321437 | A1 | 12/2009 | Polloni et al. | |
| 2011/0114518 | A1 | 5/2011 | Hein | |
| 2011/0233080 | A1 | 9/2011 | Bertuzzi et al. | |
| 2012/0006823 | A1 | 1/2012 | Bertuzzi et al. | |
| 2012/0111746 | A1 | 5/2012 | Tanbo et al. | |
| 2015/0027916 | A1 * | 1/2015 | Buse | B65B 19/025 206/268 |

OTHER PUBLICATIONS

Second Written Opinion, International Application No. PCT/IB2014/061597, mailed Apr. 23, 2015.

International Preliminary Report on Patentability, International Application No. PCT/IB2014/061597, mailed Jul. 27, 2015.

Third-party observations (with English machine translation), European Patent Application No. 14732961.9, dated Mar. 8, 2017.

* cited by examiner

PACKET WITH A RECLOSABLE SEALING PANEL

CROSS-REFERENCE TO RELATED APPLICATIONS

This application is the U.S. national phase of PCT/IB2014/061597, filed May 21, 2014, which claims the benefit of Italian Patent Application No. BO2013A000235, filed May 21, 2013.

TECHNICAL FIELD

The present invention relates to a packet with a reclosable sealing panel.

In the following description, reference is made, for the sake of simplicity, to a rigid packet of cigarettes purely by way of a non-limiting example.

BACKGROUND ART

A rigid, hinged-lid packet of cigarettes normally comprises an inner package enclosing a group of cigarettes; and a rigid outer container housing the inner package.

To better preserve the organoleptic characteristics of the cigarette tobacco, a sealed inner package has recently been proposed, which is formed by folding and heat-sealing a sheet of impermeable packing material. To permit withdrawal of the cigarettes, the sealed inner package has a cover flap normally covered by an 'open-close' type sealing panel. More specifically, the sealing panel is coated with non-dry, re-stick adhesive enabling it to be fixed repeatedly in a position sealing the inner package.

The rigid outer container normally comprises a hinged lid, which must be opened first for access to the sealing panel underneath, which must then be pulled up to withdraw a cigarette from the group inside the sealed inner package. In other words, withdrawing a cigarette from the group inside the sealed inner package involves two separate, successive opening operations (opening the rigid outer container lid, and opening the sealing panel on the sealed inner package) which must also be repeated in reverse order to close the packet of cigarettes after the cigarette is withdrawn.

Having to perform two separate, successive opening/closing operations obviously makes the packet of cigarettes awkward to use.

Patent Application US2012111746A1 describes a packet of cigarettes comprising a sealed package, which encloses a group of cigarettes and has a first cover flap defined by a cut through the sealed package and which is movable for access to the group of cigarettes; and a rigid container, which encloses the sealed package and has a second cover flap superimposed on and glued to the first cover flap of the sealed package, and which is movable with the first cover flap to allow access to the group of cigarettes. The packet of cigarettes described in Patent Application US2012111746A1, however, has several drawbacks, by requiring a fairly large amount of packing material, as well as unconventional folding of the blank from which the rigid container is formed, on account of the second cover flap forming part of the rigid container.

DESCRIPTION OF THE INVENTION

It is an object of the present invention to provide a packet with a reclosable sealing panel, designed to eliminate the above drawbacks, i.e. which can be opened/closed in one operation, and which at the same time is cheap and easy to produce.

According to the present invention, there is provided a packet with a reclosable sealing panel, as claimed in the accompanying Claims.

BRIEF DESCRIPTION OF THE DRAWINGS

A number of non-limiting embodiments of the present invention will be described by way of example with reference to the attached drawings, in which.

PREFERRED EMBODIMENTS OF THE INVENTION

Figure 1:
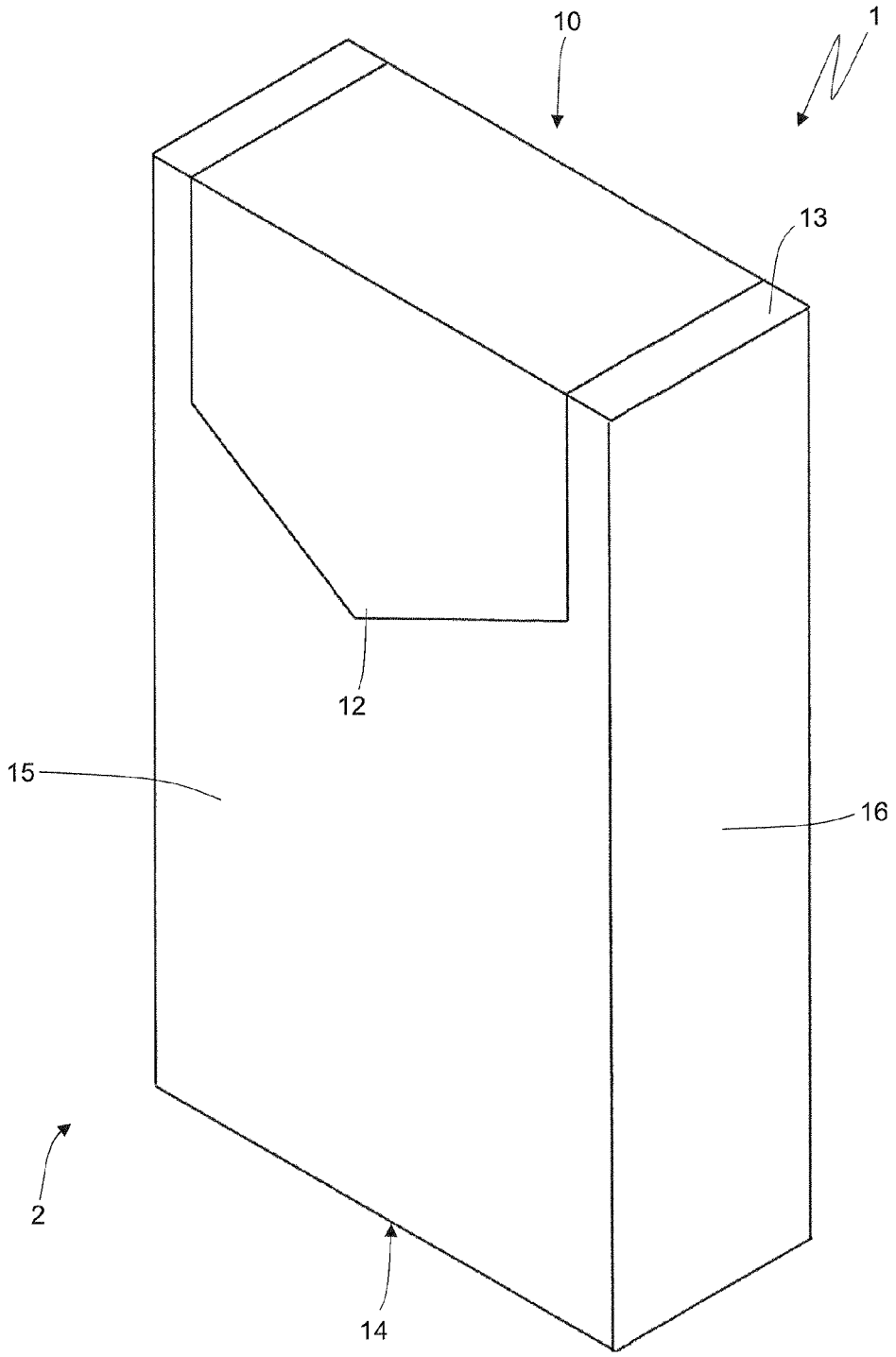
FIG. 1 shows a front view in perspective of a packet of cigarettes in accordance with the present invention in a closed configuration.
Figure 2:
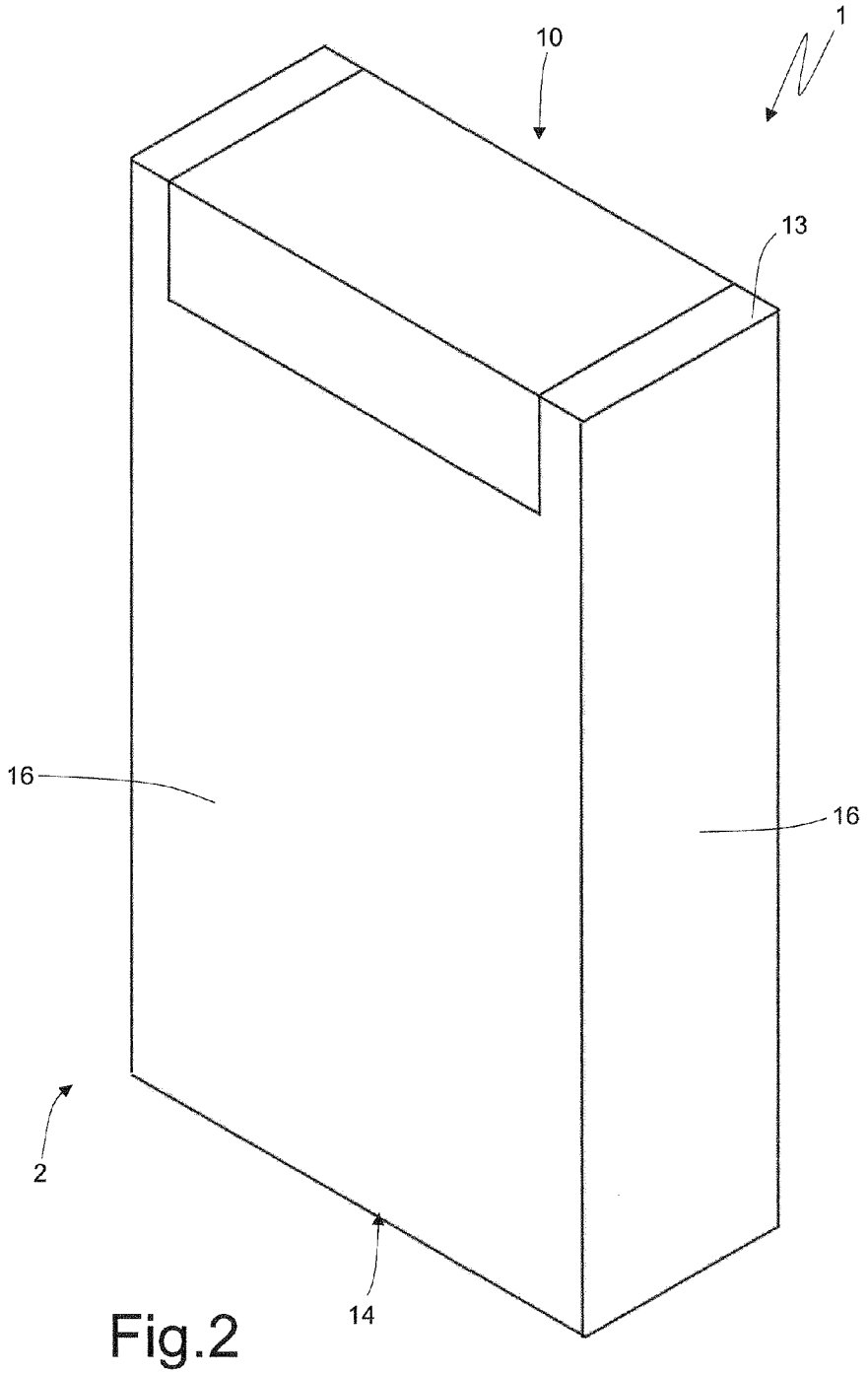
FIG. 2 shows a rear view in perspective of the FIG. 1 packet of cigarettes in a closed configuration.
Figure 3:
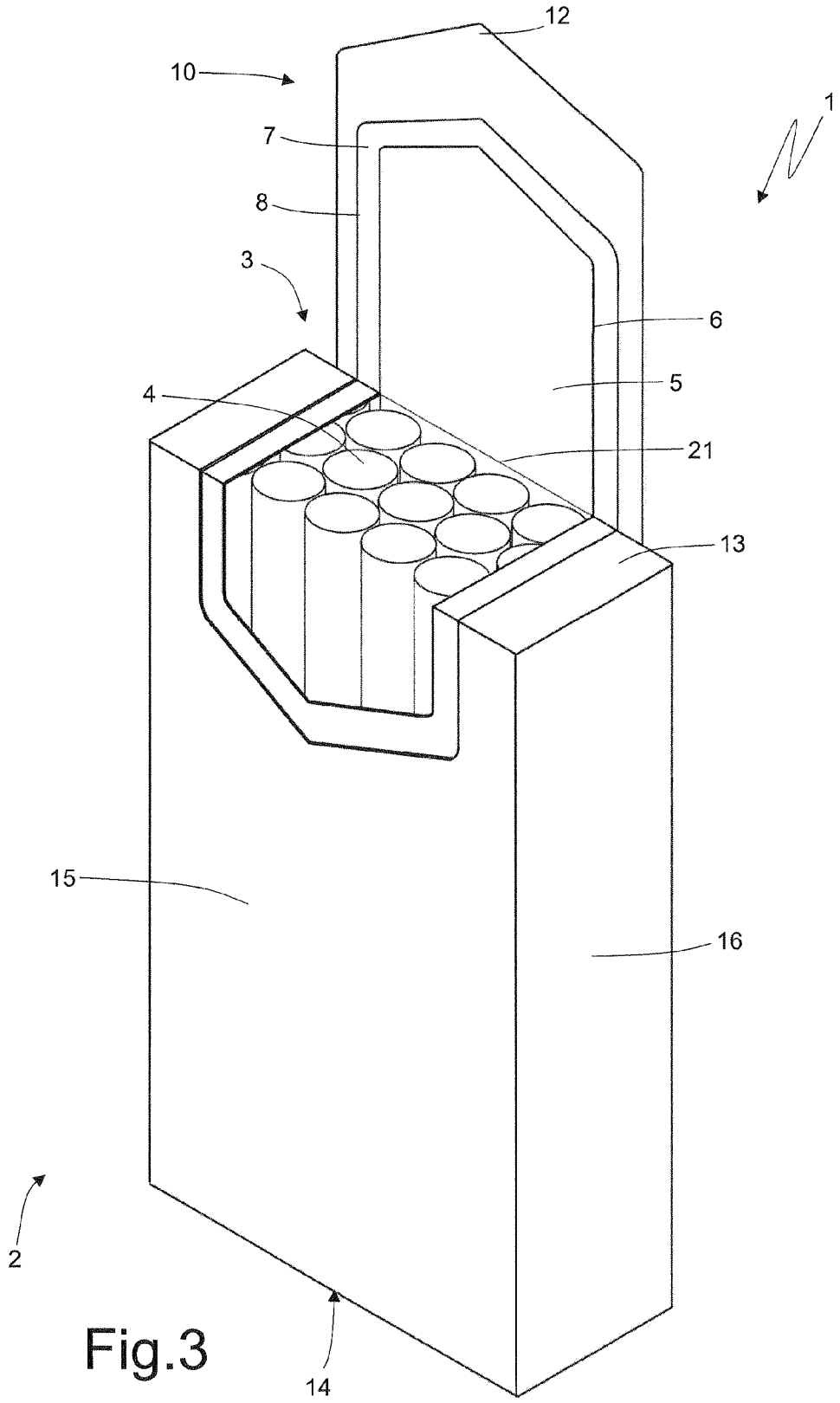
FIG. 3 shows a front view in perspective of the FIG. 1 packet of cigarettes in an open configuration.
Figure 5:
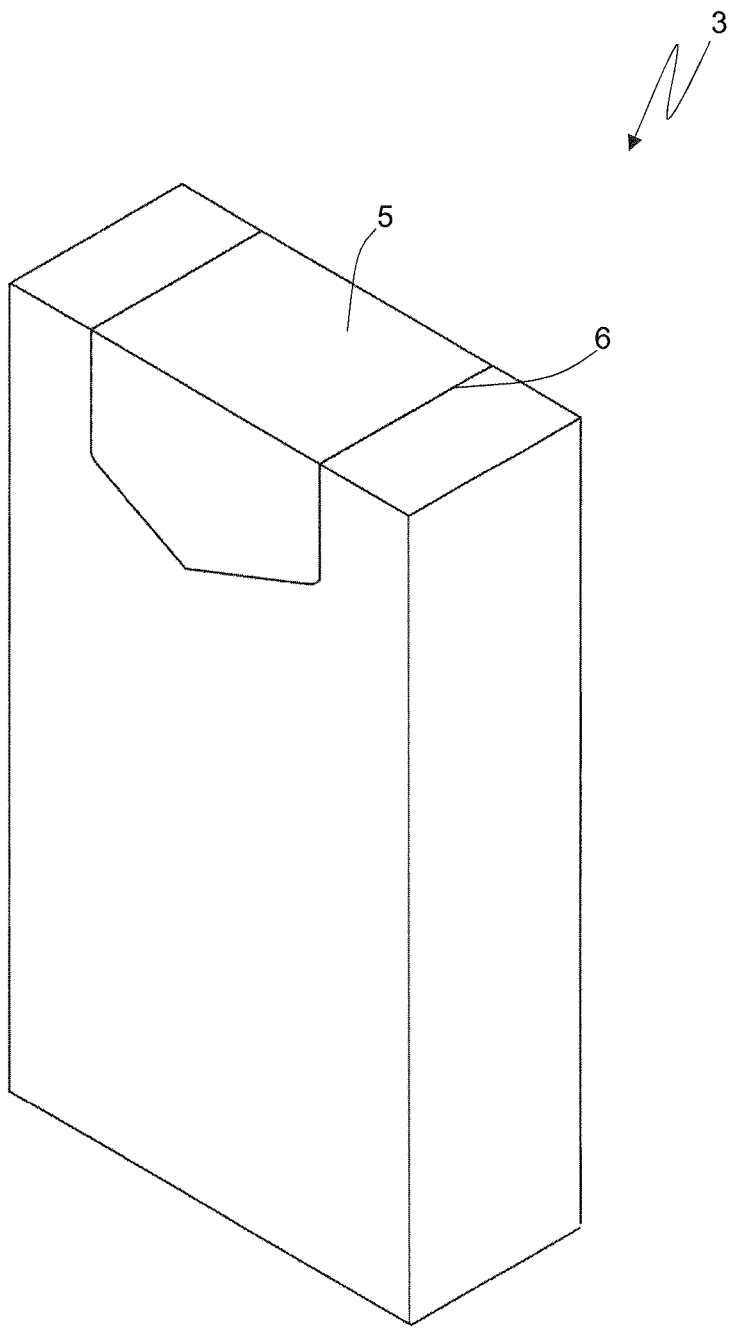
FIG. 5 shows a front view in perspective of a sealed package of the FIG. 1 packet of cigarettes.

Number 1 in FIGS. 1, 2 and 3 indicates as a whole a rigid packet of cigarettes. Packet 1 of cigarettes comprises a cardboard outer container 2; and a soft sealed package 3 (shown more clearly in FIG. 5) housed inside container 2.

Sealed package 3 encloses a parallelepiped-shaped group 4 of cigarettes (shown partly in FIG. 3) and, at the top and front, has a cover flap 5 which, for access to group 4 of cigarettes, is movable between a closed position (FIG. 5) in which cover flap 5 is coplanar with sealed package 3 to seal a corresponding extraction opening, and an open position (FIG. 3) in which cover flap 5 is lifted off sealed package 3 to open the extraction opening. Cover flap 5 is defined by a cut 6 (FIG. 3) through sealed package 3 and which extends astride a top wall and front wall of sealed package 3, i.e. cut 6 defines both cover flap 5 and a corresponding extraction opening, so lifting up cover flap 5 allows access to the extraction opening. It is important to note that cut 6 may be a through cut from the outset, or may initially be a non-through cut (i.e. a non-through incision, to avoid impairing the seal of sealed package 3) which is torn when unsealing sealed package 3 (i.e. the first time packet 1 of cigarettes is opened). In other words, to open sealed package 3, cut 6 must be a through cut to lift cover flap 5 off the rest of sealed package 3, but may initially be a non-through cut, which is torn when unsealing sealed package 3 (i.e. the first time packet 1 of cigarettes is opened).

Container 2 encloses sealed package 3 and, at the top and front, has a cover flap 7 which, for access to sealed package 3, is movable between a closed position (FIG. 1) in which cover flap 7 is coplanar with container 2 to seal a corresponding extraction opening, and an open position (FIG. 3) in which cover flap 7 is lifted up off container 2 to open the extraction opening. Cover flap 7 is defined by a cut 8 (FIG. 3) through container 2 and which extends astride a top wall and front wall of container 2, i.e. cut 8 defines both cover flap 7 and a corresponding extraction opening, so lifting up cover flap 7 allows access to the extraction opening. Because container 2 (unlike sealed package 3) is not sealed, cut 8 is normally a through cut from the outset.

Figure 6:
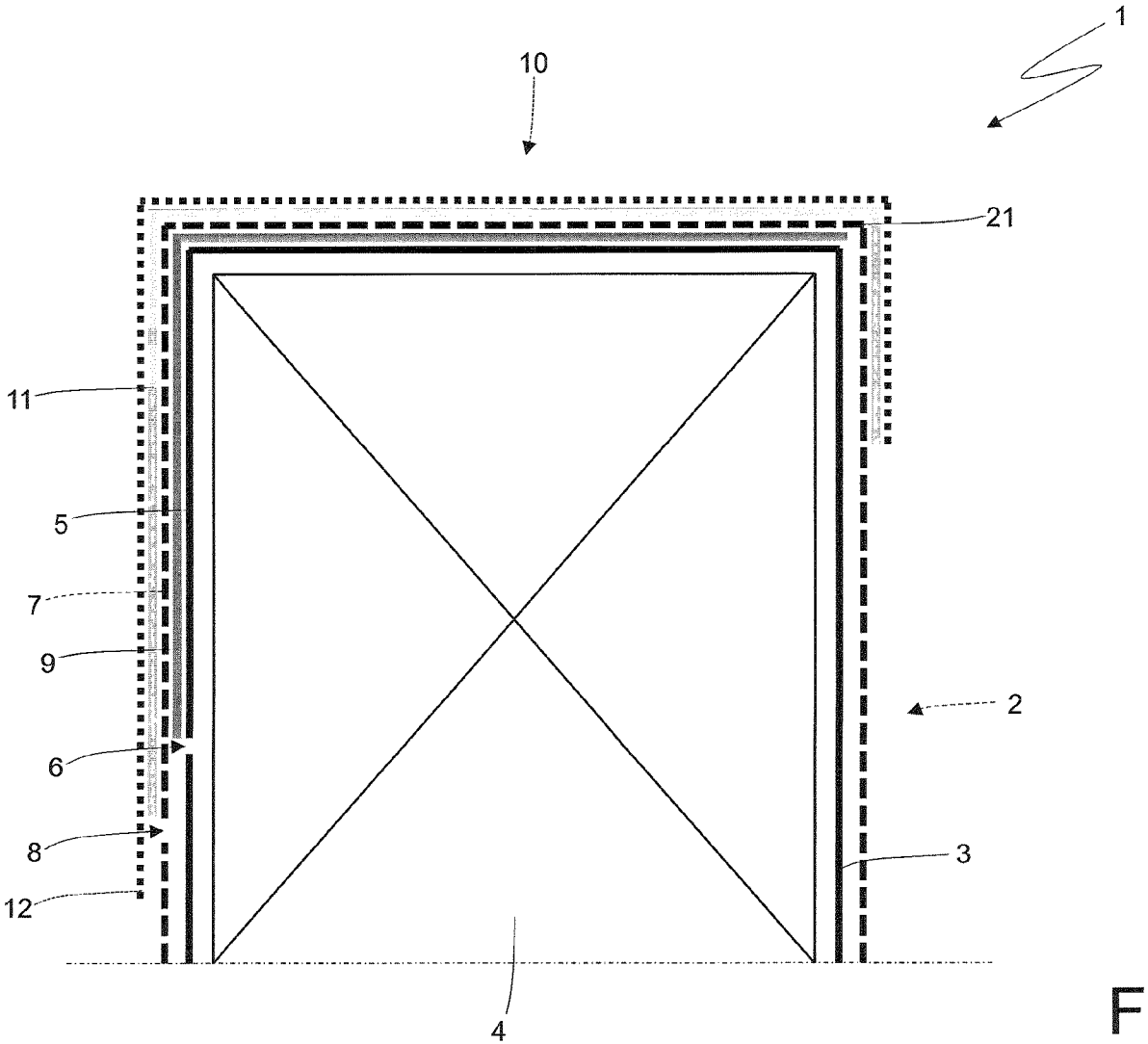
FIG. 6 shows a schematic side section, with parts removed for clarity, of a top portion of the FIG. 1 packet of cigarettes.

Cover flap 7 of container 2 is superimposed directly on and glued permanently to cover flap 5 of sealed package 3 by adhesive 9 (shown schematically in FIG. 6). Adhesive 9 is preferably permanent drying adhesive, which therefore glues cover flaps 5 and 7 to each other non-separably (unless they are torn apart).

In a preferred embodiment shown in the attached drawings and clearly in FIG. 3, cover flap 7 of container 2 is larger (in area) than cover flap 5 of sealed package 3, i.e. cover flap 5 of sealed package 3 is contained entirely within cover flap 7 of container 2. In other words, each point along cut 6 of cover flap 5 is located a given (preferably constant) distance from cut 8 of cover flap 7. In a different embodiment not shown, cover flap 7 of container 2 is the same size (area) as cover flap 5 of sealed package 3. In other words, each point along cut 6 of cover flap 5 is superimposed on and aligned with cut 8 of cover flap 7 (this embodiment permits a larger cover flap 5 to facilitate withdrawal of the cigarettes from sealed package 3).

Packet 1 of cigarettes comprises a reclosable 'open-close' adhesive panel 10 on the outside of container 2 and superimposed directly on cover flap 7 of container 2. Adhesive panel 10 is larger (in area) than cover flap 7 of container 2 (as shown clearly in FIG. 3), so cover flap 7 of container 2 is contained entirely within adhesive panel 10. In other words, each point along cut 8 of cover flap 7 is located a given distance from an edge of adhesive panel 10. On the inside (as shown schematically in FIG. 6) adhesive panel 10 is coated with non-dry, re-stick adhesive 11, i.e. which remains sticky even after a long period of time, so adhesive panel 10 is glued permanently to cover flap 7 of container 2 and releasably to a portion of container 2 around cover flap 7 (i.e. around cut 8). Non-dry, re-stick adhesive 11 allows adhesive panel 10, even over a long period of time, to be detached and re-attached repeatedly from and to container 2.

Adhesive panel 10 has a grip tab 12 with no non-dry, re-stick adhesive 11 and located along the bottom edge of adhesive panel 10. Grip tab 12 serves to make adhesive panel 10 easier to grip and lift up. In other words, to lift up adhesive panel 10, the user simply grips grip tab 12, which is in no way fixed to container 2, unlike the rest of adhesive panel 10 which is fixed to container 2 by re-stick adhesive 11.

Normally, i.e. when packet 1 of cigarettes is not in use, adhesive panel 10 adheres to the portion of container 2 around cover flap 7 (i.e. around cut 8) to close (seal) packet 1 (i.e. to keep both cover flaps 5 and 7 in the closed position. And, to withdraw a cigarette from group 4, adhesive panel 10 may be pulled up temporarily (and partially) off container 2 to lift up both flaps 5 and 7 (i.e. into the open position).

Container 2 is in the form of a rectangular parallelepiped having a top wall 13 and an opposite parallel bottom wall 14; a front wall 15 and an opposite parallel rear wall 16; and two opposite parallel lateral walls 17. Four longitudinal edges are defined between lateral walls 17 and front and rear walls 15, 16; and eight transverse edges are defined between top and bottom walls 13, 14 and front wall 15, rear wall 16, and lateral walls 17. In the embodiment shown in the drawings, all the edges are square. In other, perfectly equivalent, embodiments, some edges may obviously be bevelled or rounded.

Figure 4:
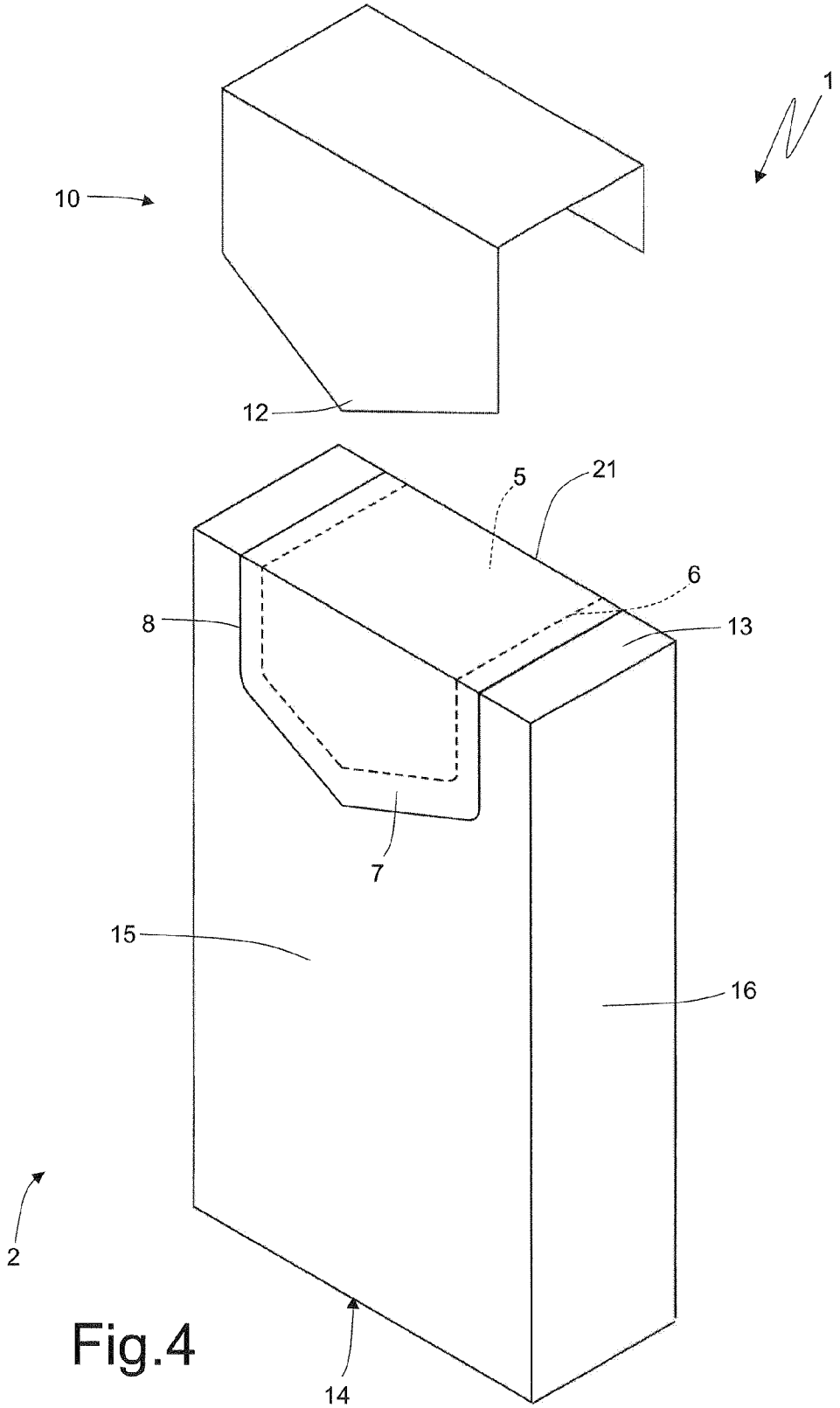
FIG. 4 shows a partly exploded front view in perspective of the FIG. 1 packet of cigarettes in a closed configuration.

Normally, i.e. when adhering to container 2 to seal packet 1 of cigarettes, adhesive panel 10 is U-shaped (as shown clearly in FIG. 4) and superimposed on front wall 15, top wall 13, and rear wall 16 of container 2.

Figure 7:
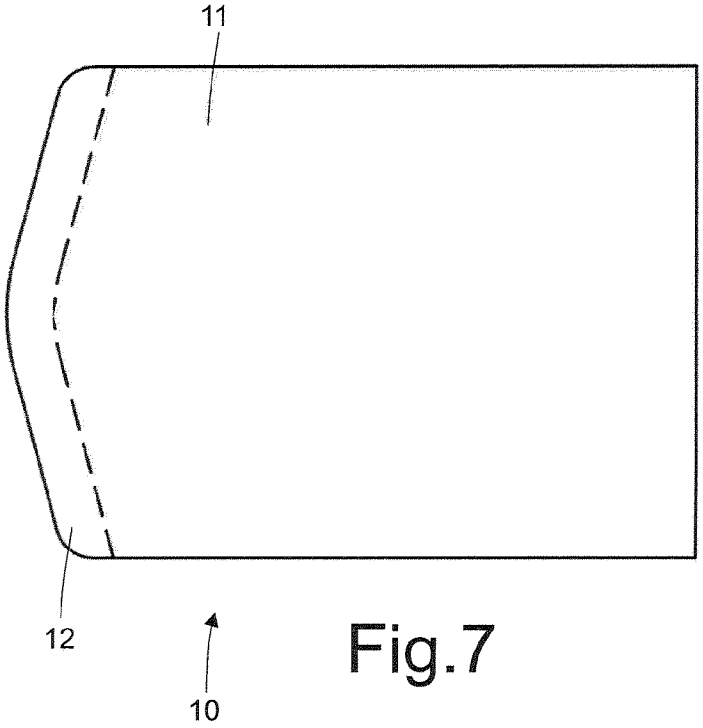

In one embodiment shown in FIG. 7, non-dry, re-stick adhesive 11 covers the whole inner face of adhesive panel 10 (except, obviously, for grip tab 12, which has no re-stick adhesive 11). In this embodiment, non-dry, re-stick adhesive 11 between adhesive panel 10 and container 2 glues cover flap 7, enclosed within cut 8, to adhesive panel 10 permanently (i.e. so the two are never separated, even in use, though theoretically they could be). So, when adhesive panel 10 is pulled up off container 2, cover flap 7 enclosed within cut 8 is also pulled up together with adhesive panel 10. Non-dry, re-stick adhesive 11 between adhesive panel 10 and container 2 also glues the portion of container 2 surrounding cover flap 7 (i.e. surrounding cut 8) temporarily (i.e. detachably, in use) to adhesive panel 10, so as to normally keep adhesive panel 10 in contact with container 2 to close packet 1 of cigarettes.

Figure 8:
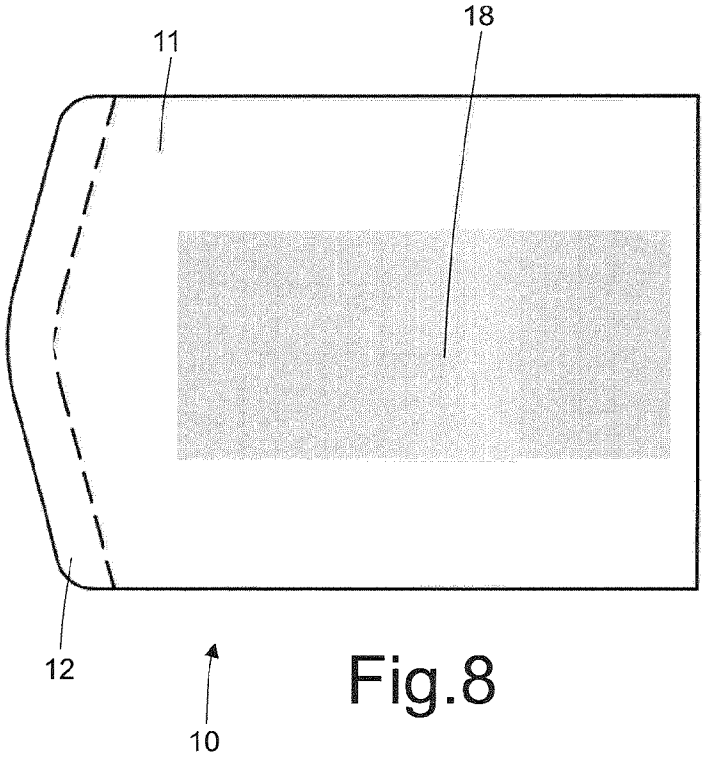
FIGS. 7 and 8 show plan views of a sealing panel fixed to the FIG. 11 blank using different types of adhesive.

In an alternative embodiment shown in FIG. 8, a further, permanent drying, adhesive 18 is interposed between adhesive panel 10 and cover flap 7 of container 2 to glue adhesive panel 10 and cover flap 7 to each other non-detachably (unless they are torn apart). The purpose of further, permanent drying, adhesive 18 is to form a stronger, more stable connection between adhesive panel 10 and cover flap 7 of container 2. Further, permanent drying, adhesive 18 preferably covers an inner portion of adhesive panel 10 smaller (in area) than cover flap 7 of container 2, so as to ensure that, regardless of all possible manufacturing tolerances, further, permanent drying, adhesive 18 always remains within cover flap 7 of container 2, at a given distance from cut 8 (i.e. never crosses over cut 8 defining cover flap 7). In fact, if further, permanent drying, adhesive were to cross over cut 8, this would result in adhesive panel 10 and the portion of container 2 surrounding cover flap 7 (i.e. surrounding cut 8) being connected non-detachably (unless they are torn apart).

Figure 9:
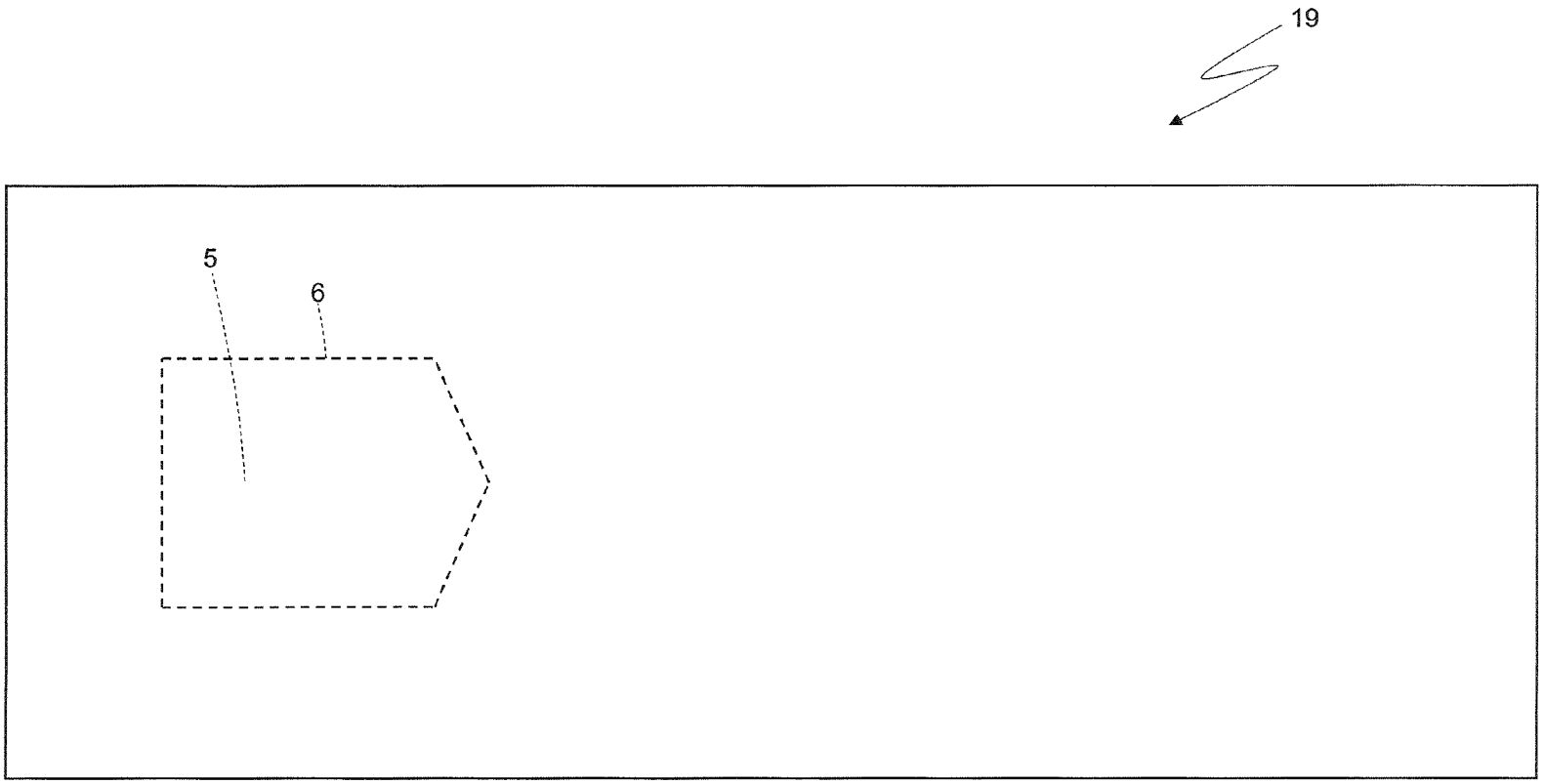
FIG. 9 shows a plan view of a sheet of packing material from which to form the FIG. 5 sealed package.

As shown in FIG. 9, sealed package 3 is formed by folding a rectangular sheet 19 of packing material having cut 6 defining cover flap 5. In the FIG. 9 embodiment, cut 6 is defined by an endless line, which means cover flap 5 is detached completely from sealed package 3, i.e. has no points that remain connected to the rest of sealed package 3. To handle and process (fold) sheet 19 of packing material, cut 6 has at least one initially undetached portion which is torn the first time cover flap 5 (i.e. packet 1 of cigarettes) is opened. As stated, initially, cut 6 is preferably a non-through cut to preserve the integrity (i.e. seal) of sealed package 3, and is torn through when unsealing sealed package 3 (i.e. packet 1 of cigarettes). In the FIG. 10 embodiment, cut 6 is defined by an open, U-shaped line, which means cover flap 5 has one side that remains connected to sealed package 3.

Figure 11:
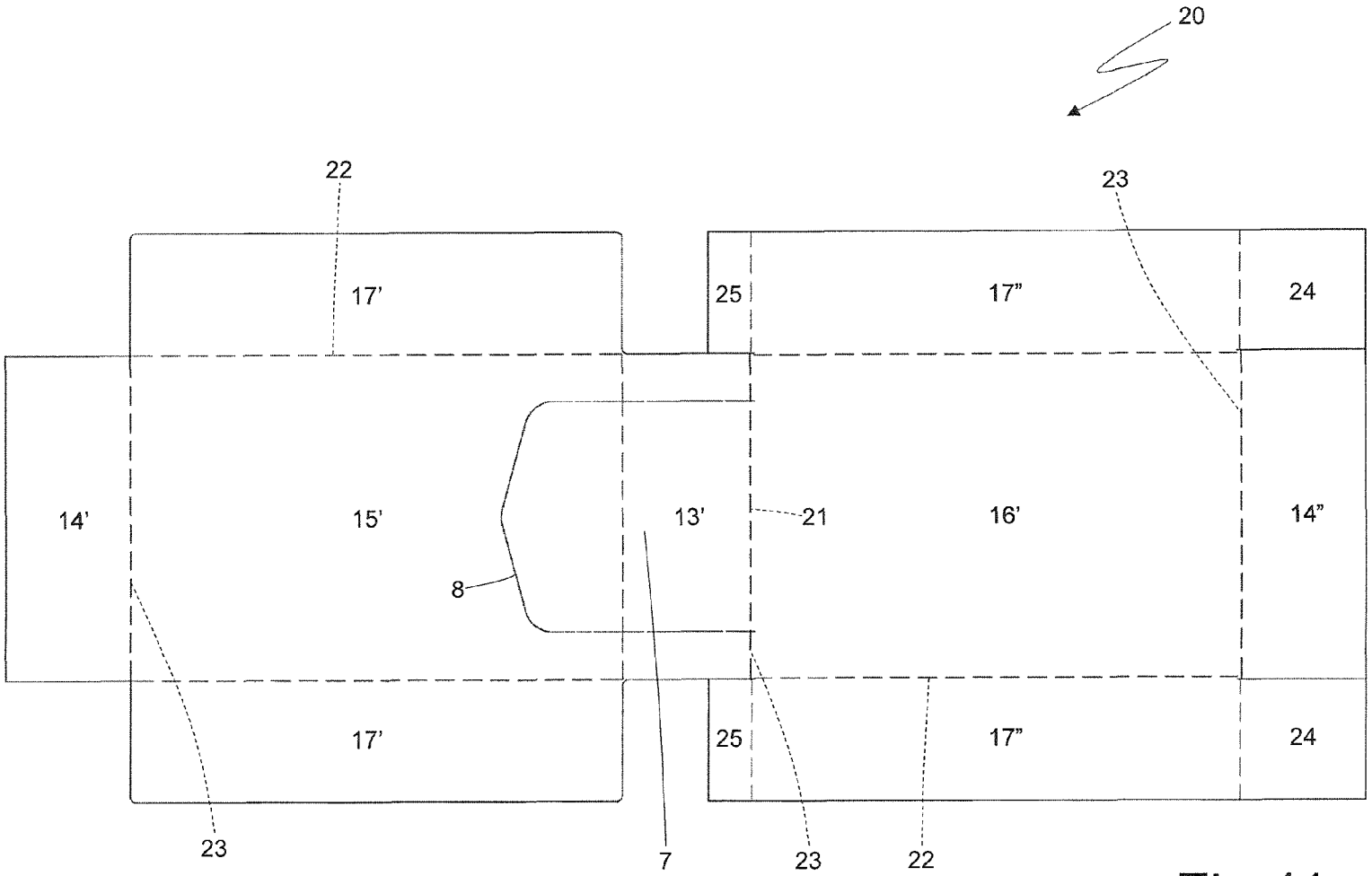
FIG. 11 shows a plan view of a blank from which to form a container of the FIG. 1 packet of cigarettes.

As shown in FIG. 11, container 2 of packet 1 of cigarettes is formed from a blank 20 which, among other things, comprises a number of parts which, where possible, are indicated using the same reference numbers, with superscripts, as for the corresponding walls of container 2.

As shown in FIG. 11, cover flap 7 of container 2 is connected to container 2 along a hinge 21, so as to move between the open and closed positions by rotating about hinge 21. And cut 8 is U-shaped, with two ends resting on hinge 21.

As shown in FIG. 11, blank 20 has two longitudinal fold lines 22, and a number of transverse fold lines 23 which define, between longitudinal fold lines 22, a panel 14' forming an outer portion of bottom wall 14 of container 2; a panel 15° forming front wall 15 of container 2; a panel 13' forming top wall 13 of container 2; a panel 16' forming rear wall 16 of container 2; and a panel 14" forming an inner portion of bottom wall 14 of container 2, and which, when folding blank 20, is superimposed on and glued to panel 14'.

Panel 15' has two wings 17', which form respective outer portions of lateral walls 17 of container 2, are located on opposite sides of panel 15', and are connected to panel 15' by longitudinal fold lines 22. Panel 16' has two wings 17", which form respective inner portions of lateral walls 17 of container 2, are located on opposite sides of panel 16', and are connected to panel 16' by longitudinal fold lines 22.

Each wing 17" has a fastening tab 24 connected to wing 17" along a transverse fold line 23, and which, when folding blank 20, is folded 90° with respect to wing 17" and glued to the inner surface of panel 14". Each wing 17" also has a fastening tab 25 connected to wing 17" along a transverse fold line 23, at the opposite end to fastening tab 24, and which, when folding blank 20, is folded 90° with respect to wing 17" and glued to the inner surface of panel 13'. Each fastening tab 25 is small enough not to overlap cut 8 (i.e. cover flap 7).

Figure 12:
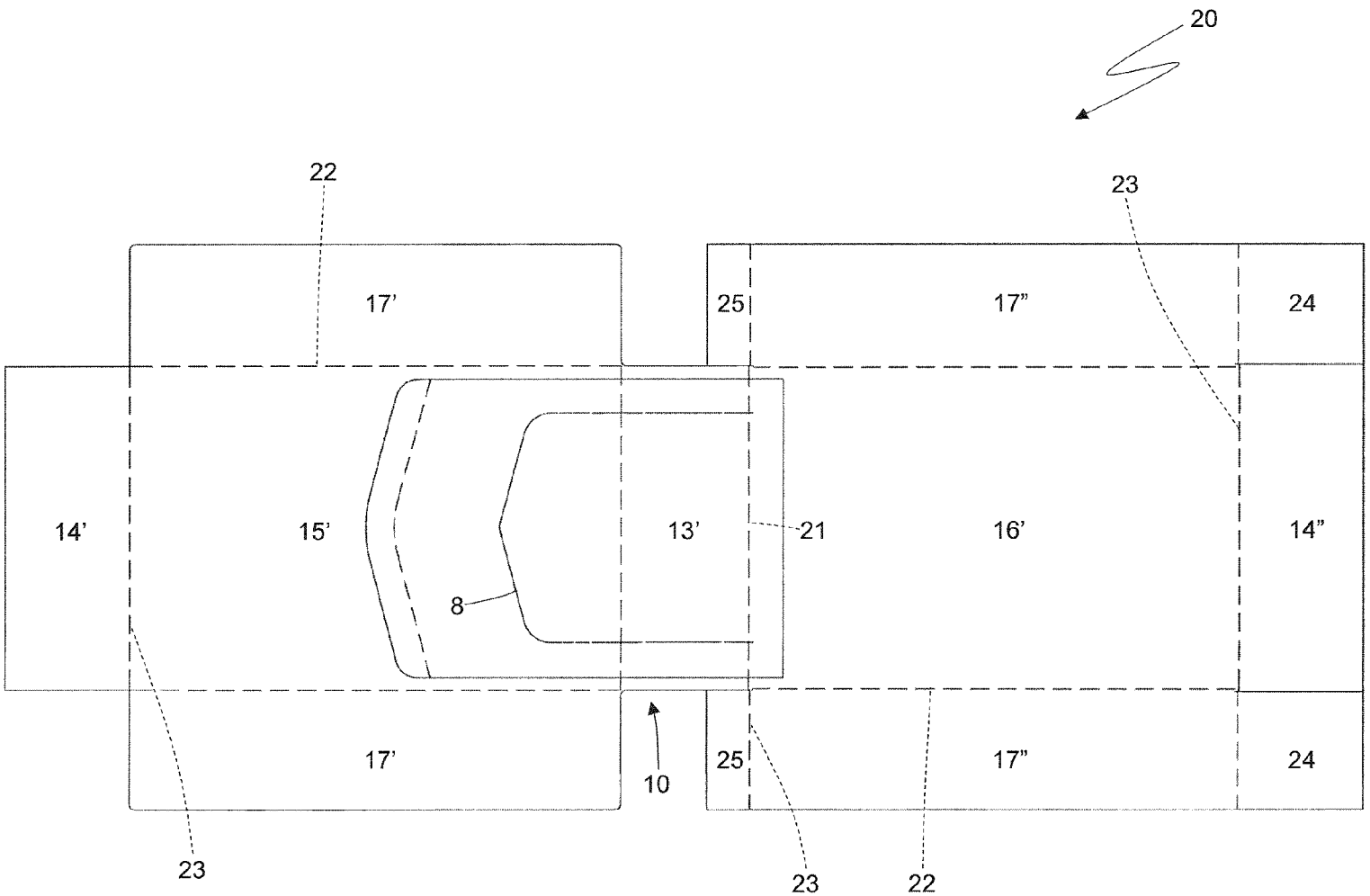
FIG. 12 shows a plan view of the FIG. 11 blank fitted with the sealing panel in FIGS. 7 and 8.

FIG. 12 shows the FIG. 11 blank 20 fitted with adhesive panel 10. Adhesive panel 10, in fact, is preferably fitted (glued) to blank 20 before folding blank 20, together with adhesive panel 10, about sealed package 3 to form container 2 of packet 1 of cigarettes.

Figure 13:
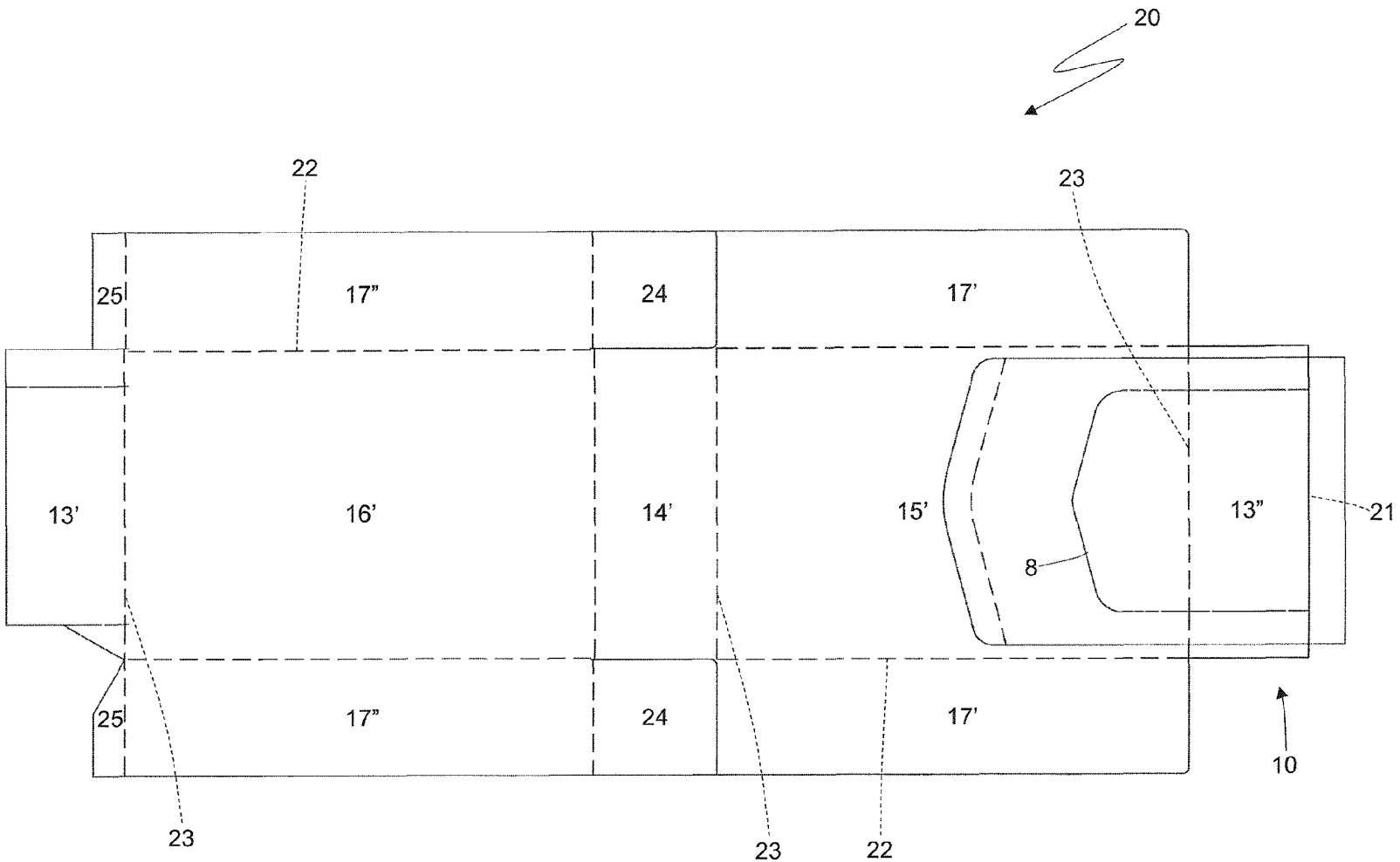
FIGS. 13 and 14 show plan views of two variations of the FIG. 11 blank.

FIG. 13 shows a different embodiment of blank 20, in which transverse fold lines 23 define, between the two longitudinal fold lines 22, a panel 13' forming an inner portion of top wall 13 of container 2; a panel 16' forming rear wall 16 of container 2; a panel 14' forming bottom wall 14 of container 2; a panel 15' forming front wall 15 of container 2; and a panel 13" forming an outer portion of top wall 13 of container 2, and which, when folding blank 20, is superimposed on and glued to panel 13'.

Figure 14:
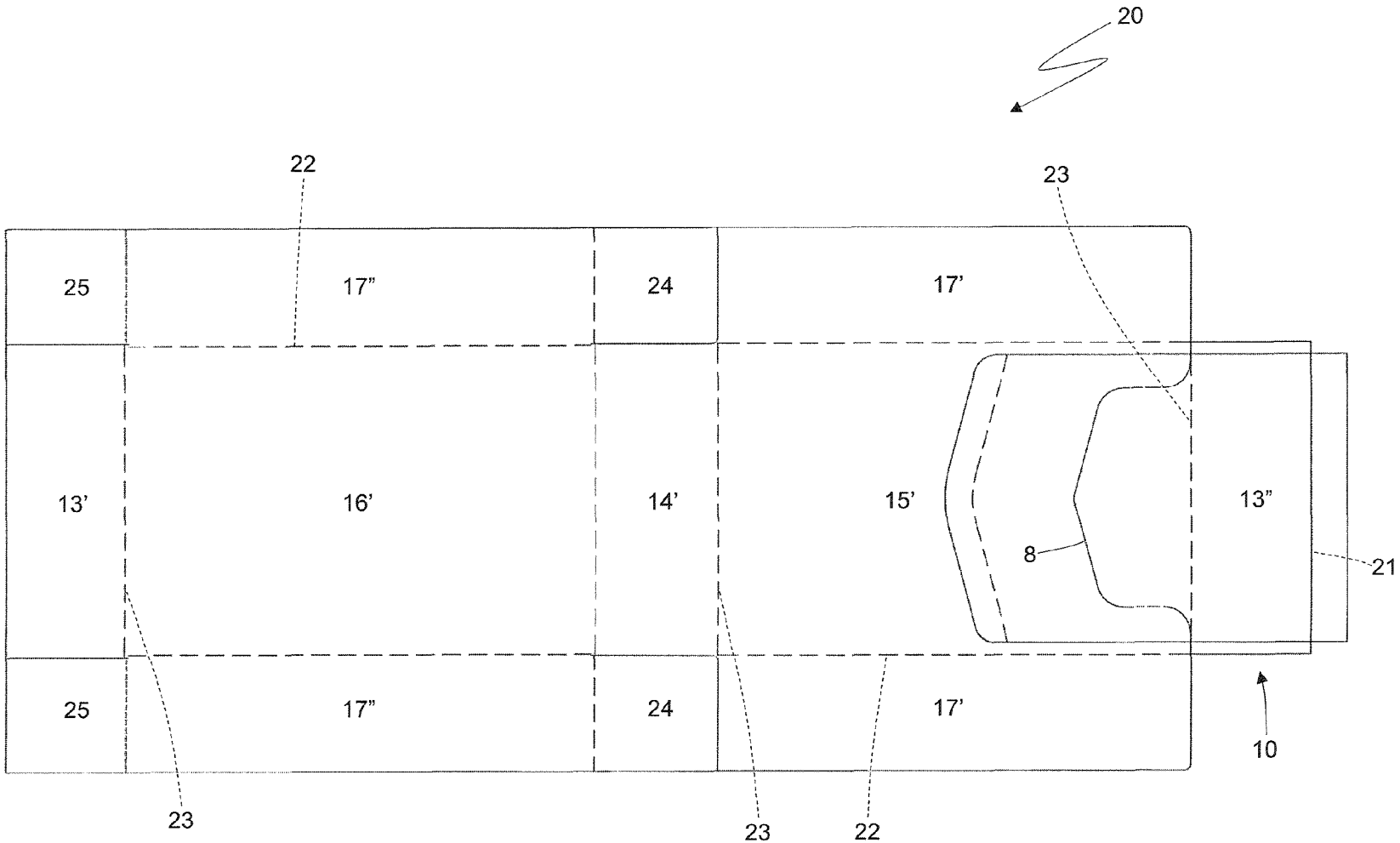

FIG. 14 shows a variation of the FIG. 13 blank 20, which is identical to the FIG. 13 blank 20 except for the shape and size of panel 13' and fastening tabs 25, and the shape of cut 8.

In the FIG. 1-14 embodiments, hinge 21 of cover flap 7 of container 2 is located along a rear transverse edge of top wall 13 of container 2, i.e. is superimposed on (coaxial with) the rear transverse edge of top wall 13. In this embodiment, cut 6 is preferably defined by an endless line (as shown in FIG. 9), so that cover flap 5 is detached completely from sealed package 3. In fact, when hinge 21 of cover flap 7 is located along the rear transverse edge of top wall 13, cover flap 5 is best detached completely from sealed package 3 to avoid severe stress (and therefore deformation) of sealed package 3 when opening adhesive panel 10.

Figure 10:
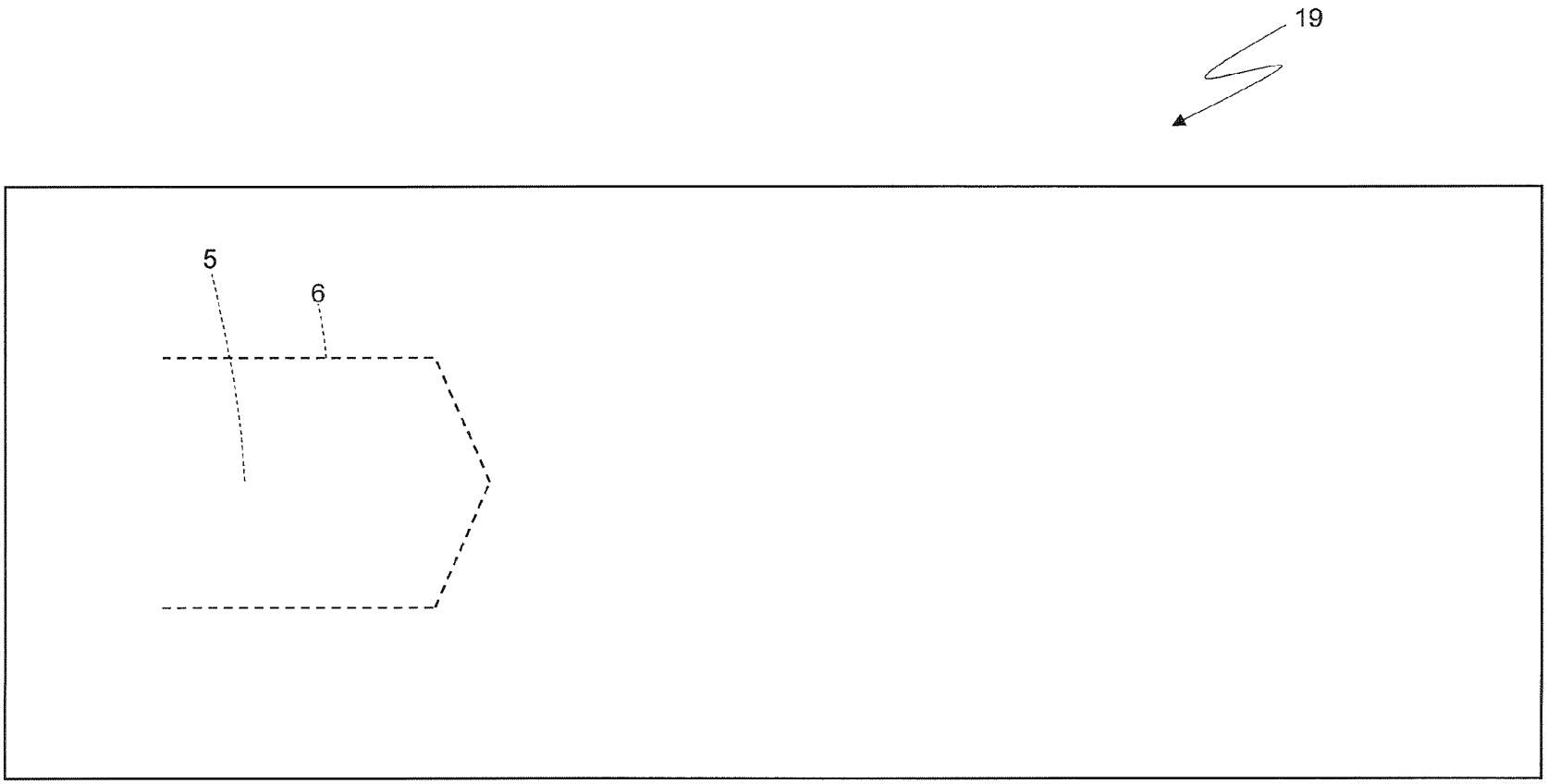
FIG. 10 shows a plan view of a variation of the FIG. 9 sheet of packing material.
Figure 15:
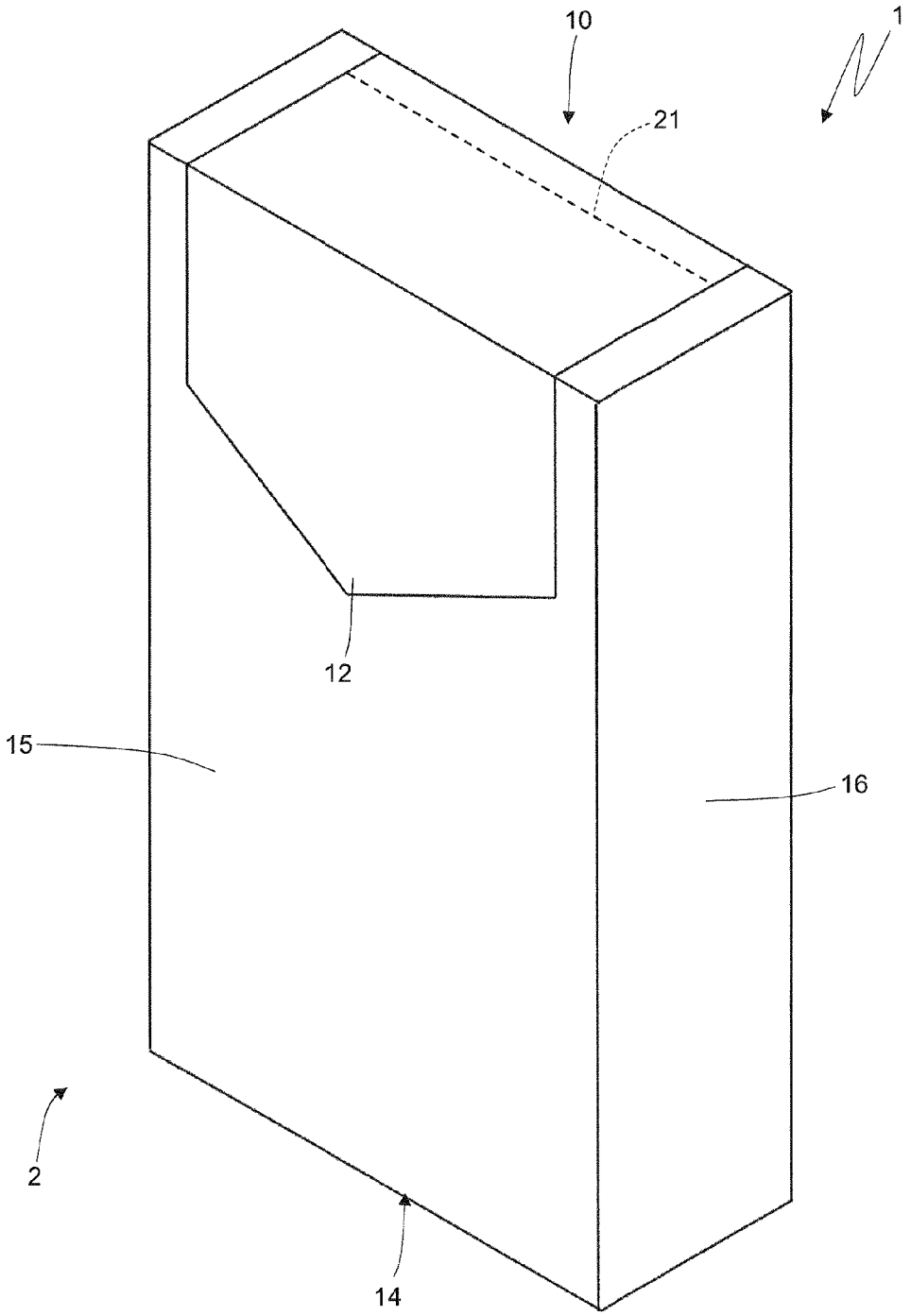
FIG. 15 shows a front view in perspective of a variation of the FIG. 1 packet of cigarettes in a closed configuration.
Figure 16:
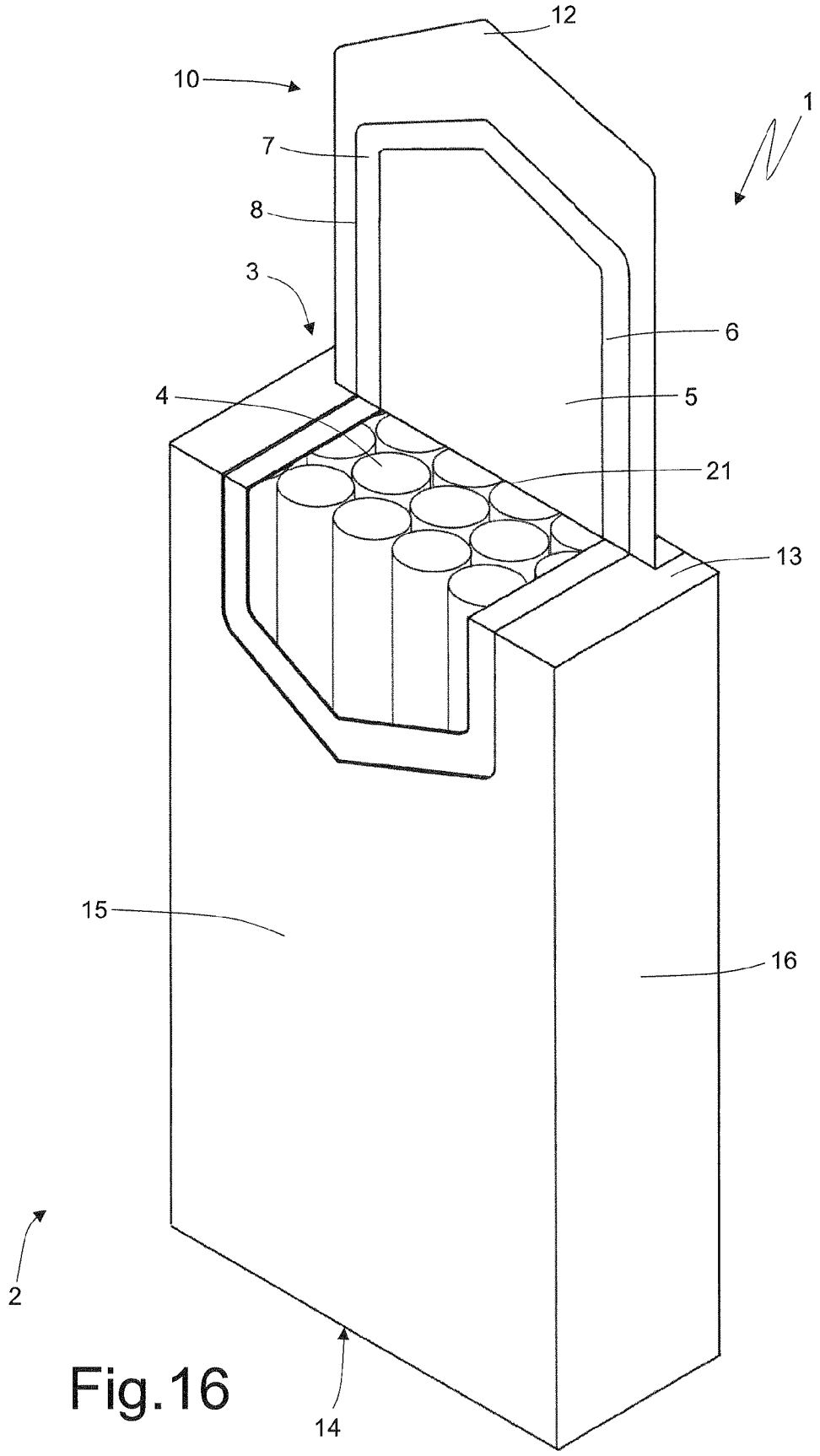
FIG. 16 shows a front view in perspective of the FIG. 15 packet of cigarettes in an open configuration.
Figure 17:
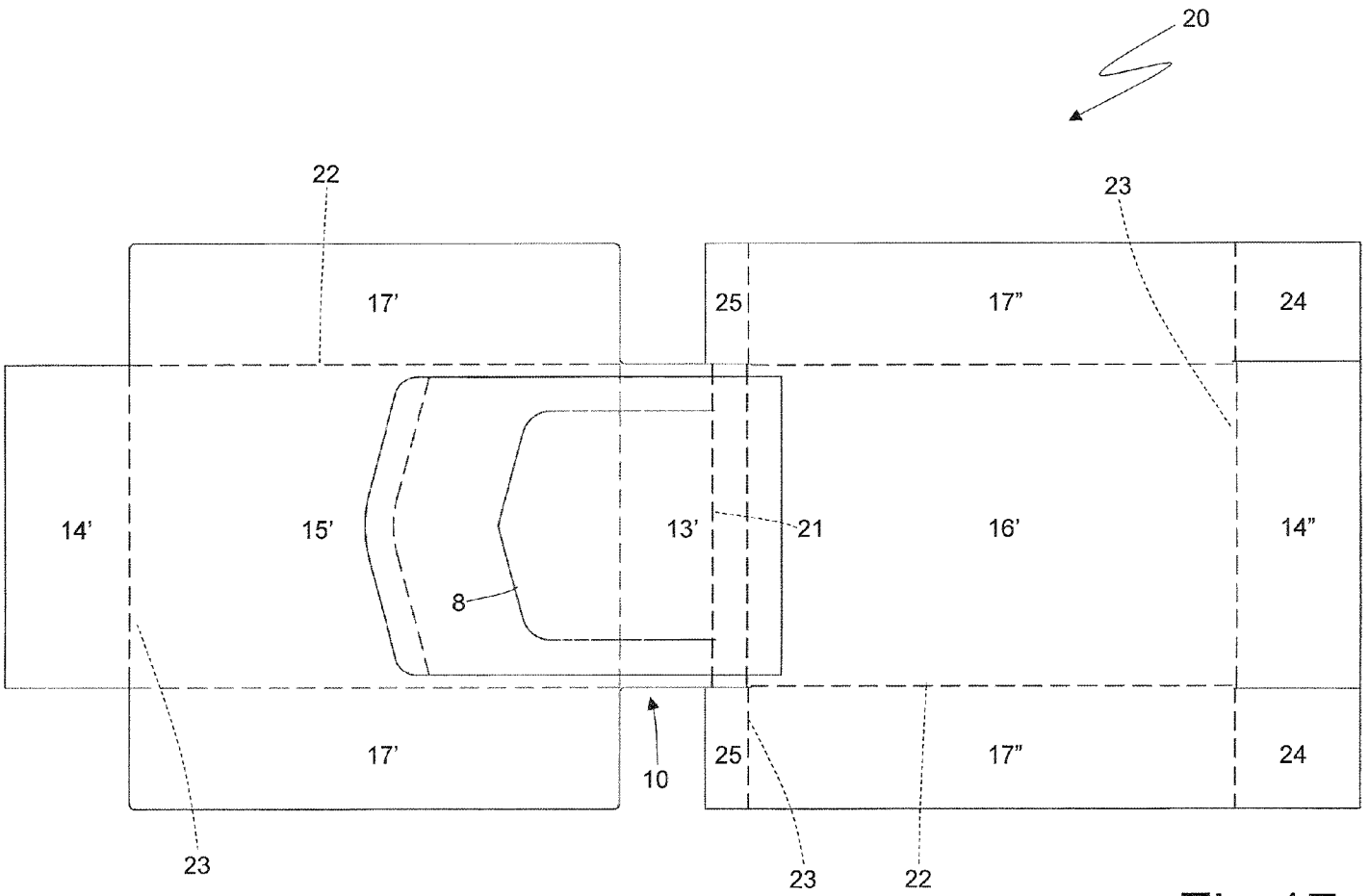
FIG. 17 shows a plan view of a blank from which to form a container of the FIG. 15 packet of cigarettes.

In the FIG. 15-17 embodiments, hinge 21 of cover flap 7 of container 2 is located on top wall 13 of container 2, between and a given distance from a front transverse edge and rear transverse edge of top wall 13. In this embodiment, cut 6 may be defined by an endless line (as shown in FIG. 9), or by a U-shaped line (as shown in FIG. 10). In fact, this embodiment, in which hinge 21 of cover flap 7 is located a given distance from the rear transverse edge of top wall 13, produces no severe stress (or deformation) of sealed package 3 when opening adhesive panel 10, even when cut 6 is defined by a U-shaped line (as shown in FIG. 10).

Packet 1 of cigarettes described has numerous advantages.

Firstly, packet 1 of cigarettes described can be opened/closed in one operation (i.e. a single movement by the user) and as such is extremely easy, quick, and intuitive to use.

Secondly, packet 1 of cigarettes described is cheap and easy to make, by being producible on a substantially standard packing machine equipped with an additional application station for applying adhesive panels 10 beforehand to blanks 20 (as shown in FIGS. 12-14 and 17).

Lastly, packet 1 of cigarettes described can be made from a relatively small amount of packing material, in that adhesive panel 10 is relatively thin (compared with the thickness of sheet 19 of packing material and blank 20) and so does not significantly increase the total amount of packing material required.

In the non-limiting embodiment shown in the attached drawings, packet 1 according to the invention contains a group 4 of cigarettes; but, given its numerous advantages, packet 1 according to the present invention may also be used for other than cigarettes, such as foodstuffs (sweets, chocolates or other confectionary).

The invention claimed is:

1. A rigid packet (1) comprising:

a group (4) of articles;

a soft sealed package (3) enclosing the group (4) of articles and having a first cover flap (5), which is defined by a first cut (6) through the sealed package (3) and is movable to allow access to the group (4) of articles;

a rigid cardboard outer container (2) enclosing the sealed package (3) and having a second cover flap (7), which is defined by a second cut (8) through the container (2), is superimposed on the first cover flap (5) of the sealed package (3), and is movable to allow access to the sealed package (3); and a reclosable adhesive panel (10), which is coated on the inside with a first re-stick adhesive (11), and has at least one grip tab (12) with no first re-stick adhesive (11) and located at an edge of the adhesive panel (10);

wherein the container (2) is in the form of a rectangular parallelepiped having a top wall (13) and an opposite parallel bottom wall (14); a front wall (15) and an opposite parallel rear wall (16); and two opposite parallel lateral walls (17);

wherein:

the second cover flap (7) is superimposed directly on the first cover flap (5), and is glued permanently to the first cover flap (5), the adhesive panel (10) is located outside the container (2), is larger than the second cover flap (7), is superimposed on the second cover flap (7), is glued permanently to the second cover flap (7), and is glued releasably by the first re-stick adhesive (11) to a portion of the container (2) surrounding the second cover flap (7)), and the container (2) provided with the adhesive panel (10) is arranged on the outside of the soft sealed package (3)

such that the container (2) is the most outer element of the rigid packet (1), the container (2) is not inserted in any other container, and the container is always visible from the outside.

2. A packet (1) as claimed in claim 1, wherein the second cover flap (7) is connected to the container (2) along a hinge (21).

3. A packet (1) as claimed in claim 2, wherein the second cut (8) is U-shaped, and has two ends resting on the hinge (21).

4. A packet (1) as claimed in claim 2, wherein the hinge (21) is located at a rear transverse edge of a top wall (13) of the container (2).

5. A packet (1) as claimed in claim 2, wherein the hinge (21) is located on a top wall (13) of the container (2), between a front transverse edge and a rear transverse edge of the top wall (13), and at a given distance from both the front transverse edge and the rear transverse edge.

6. A packet (1) as claimed in claim 1, wherein the first cut (6) is defined by an endless line.

7. A packet (1) as claimed in claim 6, wherein the first cover flap (5) is detached completely from the sealed package (3).

8. A packet (1) as claimed in claim 6, wherein the first cut (6) comprises at least one initially undetached portion, which is torn when the first cover flap (5) is first opened.

9. A packet (1) as claimed in claim 1, wherein the first cut (6) is U-shaped.

10. A packet (1) as claimed in claim 1, wherein the second cover flap (7) is glued permanently to the first cover flap (5) by a second permanent, drying adhesive (9).

11. A packet (1) as claimed in claim 1, wherein the adhesive panel (10) is glued to the second cover flap (7) solely by the first re-stick adhesive (11).

12. A packet (1) as claimed in claim 1, wherein the adhesive panel (10) is also glued to the second cover flap (7) by a third permanent, drying adhesive (18).

13. A packet (1) as claimed in claim 12, wherein the third permanent, drying adhesive (18) covers an inner area of the adhesive panel (10) smaller than the second cover flap (7).

14. A packet (1) as claimed in claim 1, wherein the second cover flap (7) is larger than the first cover flap (5).

15. A packet (1) as claimed in claim 1, wherein the container (2) is formed by folding a blank (20) having two longitudinal fold lines (22), and a number of transverse fold lines (23) which define, between the two longitudinal fold lines (22):

a first panel (14') forming an outer portion of a bottom wall (14) of the container (2);

a second panel (15') forming a front wall (15) of the container (2);

a third panel (13') forming a top wall (13) of the container (2);

a fourth panel (16') forming a rear wall (16) of the container (2); and a fifth panel (14") forming an inner portion of the bottom wall (14) of the container (2), and which is superimposed on and glued to the first panel (14') when folding the blank (20).

16. A packet (1) as claimed in claim 15, wherein:

the second panel (15') has two first wings (17'), which form respective outer portions of the lateral walls (17) of the container (2), are located on opposite sides of the second panel (15'), and are connected to the second panel (15') by the longitudinal fold lines (22);

the fourth panel (16') has two second wings (17"), which form respective inner portions of the lateral walls (17) of the container (2), are located on opposite sides of the fourth panel (16'), and are connected to the fourth panel (16') by the longitudinal fold lines (22);

each second wing (17") has a first fastening tab (24), which is connected to the second wing (17") along a transverse fold line (23) and, when folding the blank (20), is folded 90° with respect to the second wing (17") and glued to an inner surface of the fifth panel (14"); and each second wing (17") has a second fastening tab (25), which is connected to the second wing (17") along a transverse fold line (23), at the opposite end from the first fastening tab (24), and which, when folding the blank (20), is folded 90° with respect to the second wing (17") and glued to an inner surface of the third panel (13').

17. A packet (1) as claimed in claim 16, wherein each second fastening tab (25) is small, so as not to overlap the second cut (8).

18. A packet (1) as claimed in claim 1, wherein the container (2) is formed by folding a blank (20) having two longitudinal fold lines (22), and a number of transverse fold lines (23) which define, between the two longitudinal fold lines (22):

a first panel (13') forming an inner portion of a top wall (13) of the container (2);

a second panel (16') forming a rear wall (16) of the container (2);

a third panel (14') forming a bottom wall (14) of the container (2);

a fourth panel (15') forming a front wall (15) of the container (2); and a fifth panel (13") forming an outer portion of the top wall (13) of the container (2), and which is superimposed on and glued to the first panel (13') when folding the blank (20).

* * * * *